US007044775B2

(12) United States Patent
Yang

(10) Patent No.: US 7,044,775 B2
(45) Date of Patent: May 16, 2006

(54) ELECTRONIC APPARATUS HAVING FUNCTION OF RECEIVING POWER CORD

(75) Inventor: I-Jung Yang, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/851,256

(22) Filed: May 21, 2004

(65) Prior Publication Data

US 2005/0090142 A1 Apr. 28, 2005

(30) Foreign Application Priority Data

Oct. 23, 2003 (TW) ..... 92129484 A

(51) Int. Cl.
*H01R 11/00* (2006.01)

(52) U.S. Cl. ..... 439/502; 439/528; 439/357; 439/485; D8/359; 361/826

(58) Field of Classification Search ..... 439/502, 439/528, 357, 485; D8/359; 361/826
See application file for complete search history.

(56) References Cited

U.S. PATENT DOCUMENTS

| | | | | |
|---|---|---|---|---|
| D428,327 | S * | 7/2000 | Stekelenburg | D8/359 |
| 6,117,077 | A * | 9/2000 | Del Mar et al. | 600/301 |
| 6,386,908 | B1 * | 5/2002 | Kato et al. | 439/528 |
| 6,503,097 | B1 * | 1/2003 | Archambault | 439/501 |
| 6,567,277 | B1 * | 5/2003 | Doherty et al. | 361/826 |
| 6,636,432 | B1 * | 10/2003 | Chao | 363/146 |
| 6,705,890 | B1 * | 3/2004 | Kitou et al. | 439/528 |

* cited by examiner

*Primary Examiner*—Truc Nguyen
(74) *Attorney, Agent, or Firm*—Madson & Austin

(57) ABSTRACT

An electronic apparatus having a function of receiving a power cord is disclosed. The electronic apparatus having a function of receiving a power cord comprises a main body, a power cord and at least a receiving element. The power cord is connected to a first side of the main body, and the receiving element is disposed on a second side of the main body and has a base plate and two boards. The two boards are respectively connected to two opposite sides of the base plate for allowing the power cord to be wound around the electronic apparatus and received at a receiving space formed between the two boards.

14 Claims, 6 Drawing Sheets

ELECTRONIC APPARATUS HAVING FUNCTION OF RECEIVING POWER CORD

FIELD OF THE INVENTION

The present invention relates generally to an electronic apparatus having a function of receiving a power cord, and more particularly to an adapter or a power supply having a function of receiving a power cord thereof.

BACKGROUND OF THE INVENTION

The adapter, power supply or charger is a popular electronic apparatus used in our daily life. The adapter, power supply or charger is generally employed to rectify and convert commercially available AC power into DC power, so as to supply the required power to operate or charge the power-receiving device, such as printer, notebook or cellular phone.

Please refer to FIG. 1 which is a diagram illustrating a structure of a conventional adapter. As shown in FIG. 1, the conventional adapter includes a housing 11 and a power cord 13. The housing 11 has a surface 12 having a hole for passing the power cord 13 therethrough. The power cord 13 is electrically connected to an internal printed circuit board (not shown in FIG. 1) of the adapter and used as an outlet of the adapter for providing the required DC power to the power-receiving device.

Since the power cord 13 has a length of from about 1 to 10 meters, a special consideration should be given to secure the power cord 13. A strap 14 is widely used to secure a bundled power cord 13 for storage. When the adapter is employed, the strap 14 has to be unfastened in advance and the power cord 13 can be stretched out to connect with a power-receiving device.

However, there still exist some disadvantages in practice by using the above-mentioned strap 14 to receive and secure the power cord 13 of the adapter.

1. The bundling strap 14 is readily lost, because the strap 14 is separable from the housing 11 of the adapter.
2. After the power cord 13 is bundled by the strap 14, the bundled power cord 13 not only occupies a lot of space for storage but also gets entangled with other power cords or wires easily.
3. If the power cord 13 is separable from the adapter, it is easily lost when it is put away in the different place.

Therefore, there is a need to provide an electronic apparatus having a function of receiving a power cord so as to overcome the above problems encountered in the prior art.

SUMMARY OF THE INVENTION

An object of the present invention is to provide an electronic apparatus having a function of receiving a power cord for efficiently receiving the power cord and conveniently putting the electronic apparatus away.

For the purpose of attaining the foregoing object, the present invention provides an electronic apparatus having a function of receiving a power cord. The electronic apparatus includes a main body, a power cord connected to a first side of the main body, and at least a receiving element disposed on a second side of the main body and having a base plate and two boards, wherein the two boards are respectively connected to two opposite sides of the base plate, thereby allowing the power cord to be wound around the electronic apparatus and received at a receiving space formed between the two boards.

In accordance with the above-mentioned aspect of the present invention, the electronic apparatus is one selected from a group consisting of an adapter, a power supply and a charger.

In accordance with the above-mentioned aspect of the present invention, the main body and the base plate further have a first connecting device therebetween.

For example, the first connecting device may be a twin adhesive or a Velcro. Preferably, the first connecting device may comprise a block and a hole. The block and the hole are accordingly and respectively disposed on the second side of the main body and the base plate so as to engage the block in the hole and thereby allowing the receiving element to be disposed on the second side of the main body.

In accordance with the above-mentioned aspect of the present invention, the hole of the first connecting device may further have a circular hole and a column-shaped hole, wherein the width of the block is between the circular hole and the column-shaped hole so as to dispose the block into the hole through the circular hole and then engage the block by the column-shaped hole.

In accordance with the above-mentioned aspect of the present invention, the base plate and the board further have a second connecting device therebetween. For example, the second connecting device may comprise a protrusion and an indentation accordingly and respectively disposed on one side of the base plate and bottom of the board so as to engage the protrusion in the indentation and thereby allowing the board to be connected to the base plate.

Preferably, the second connecting device comprises a cylinder disposed on one side of the base plate and having a plurality of grooves respectively disposed on the surface of the cylinder, wherein the grooves are capable of holding the board so as to position the board.

In accordance with the above-mentioned aspect of the present invention, the base plate and the board of the receiving element can be shaped in a rectangle, a rhombus, a triangle, a circle or an ellipse.

In accordance with the above-mentioned aspect of the present invention, the receiving element further comprises a sheet metal covering the base plate or the board of the receiving element.

In accordance with the above-mentioned aspect of the present invention, the receiving element further comprises a through hole or a blind hole.

BRIEF DESCRIPTION OF THE DRAWINGS

The present invention may be best understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention provides an electronic apparatus having a power cord receiving function. Although the following embodiments use adapters as exemplifications, the electronic apparatus can be a battery charger, a power supply, a transformer or any electronic apparatus having a power cord.

Figure 1:
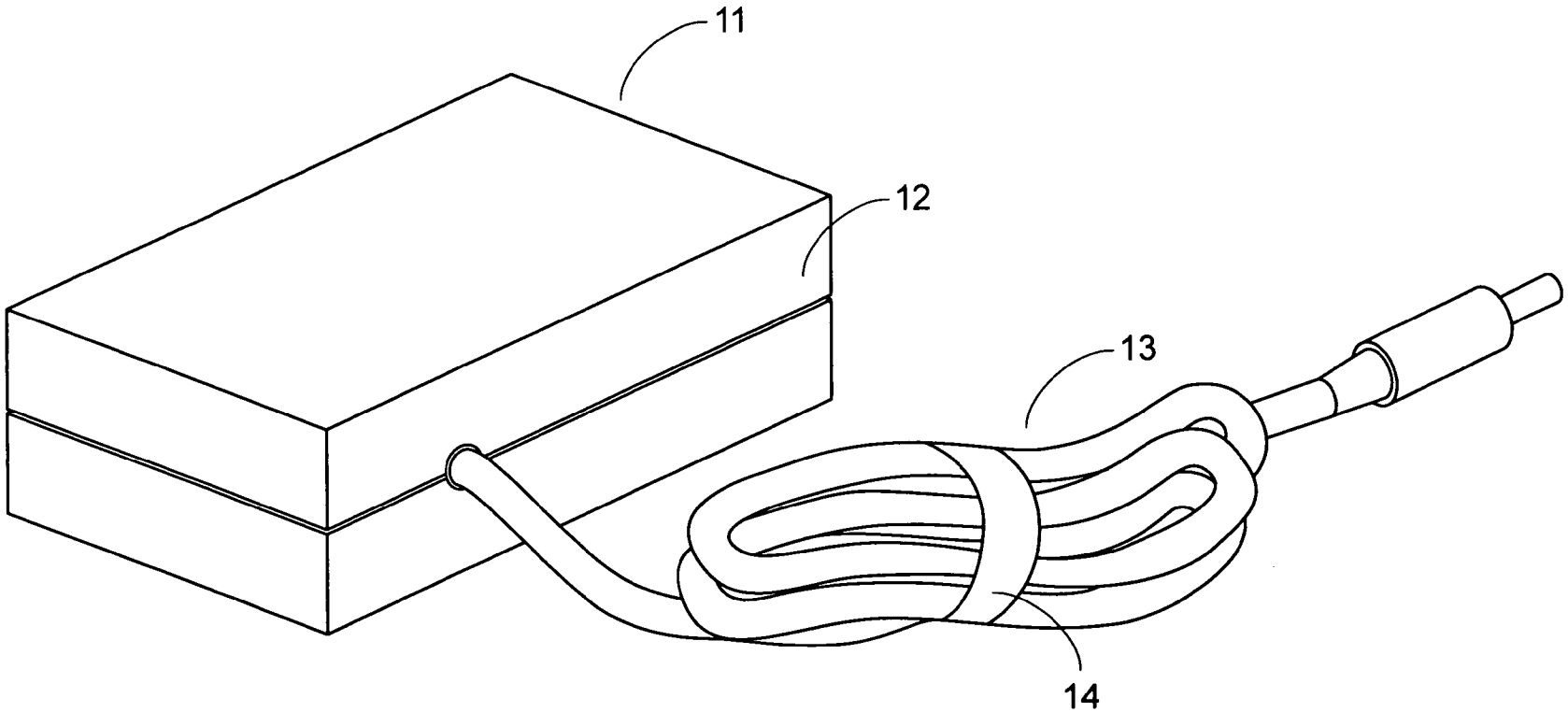
Fig. 1 (Prior Art)
FIG. 1 is a schematic diagram showing the structure of a conventional adapter.
Figure 2:
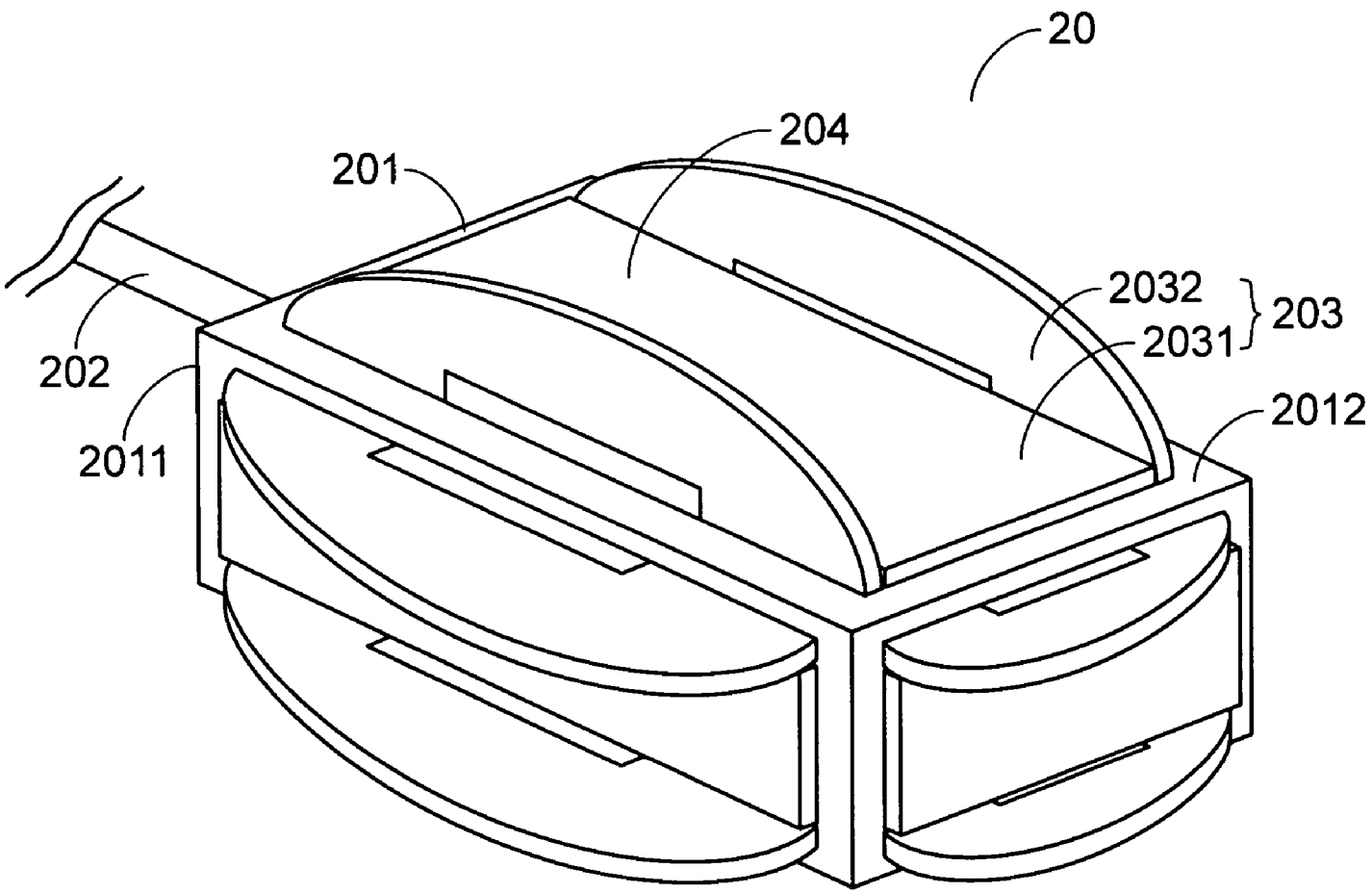
FIG. 2 is a schematic diagram showing the adapter having a function of receiving a power cord according to a preferred embodiment the present invention.

Please refer to FIG. 2, which is a schematic diagram showing the adapter having a function of receiving a power cord according to a preferred embodiment the present invention. As shown in FIG. 2, the adapter 20 includes a main body 201, a power cord 202 and a plurality of receiving elements 203. The power cord 202 is passing through from a first side 2011 of the main body 201, and the receiving elements 203 are respectively disposed on several second sides 2012 of the main body 201 and comprise a base plate 2031 and two boards 2032 respectively connected to two opposite sides of the base plate 2031. Therefore, a receiving space 204 is formed between the two boards 2031 for receiving and maintaining the power cord thereon.

In the described embodiment, each board 2032 may have a specific height no less than 3 mm to form the receiving space 204 therebetween for receiving and maintaining the power cord 202 completely, no matter how long the power cord 202 is. Besides, each board 2032 can also work as a protecting wall for preventing the received power cord from loosing and drooping. Moreover, the board 2032 can prevent the electronic apparatus from contacting other objects directly with its height so as to allow the air to flow around the electronic apparatus for improving heat-dissipating effect.

Figure 3:
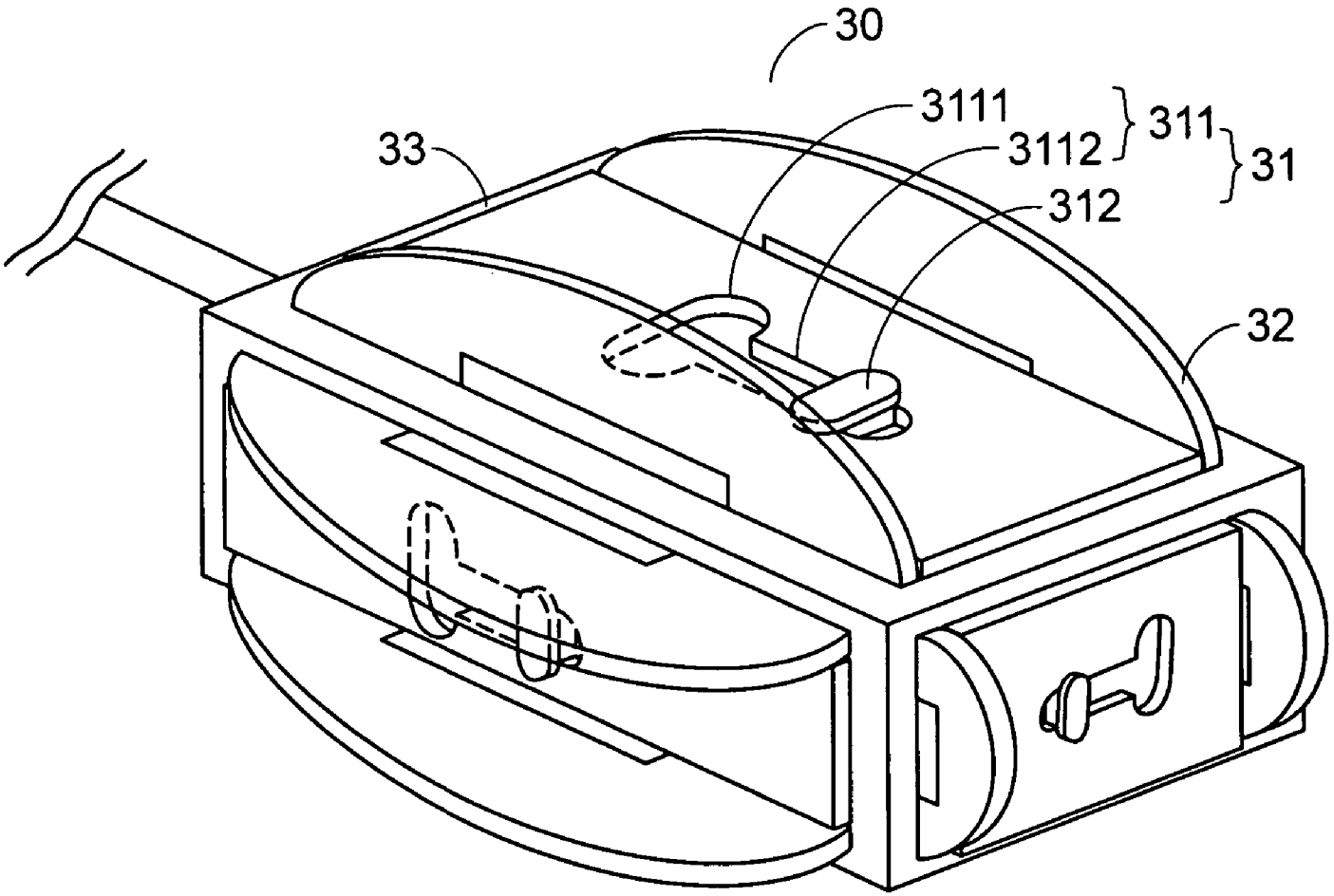
FIG. 3 is a schematic diagram showing the first connecting device according to a preferred embodiment of the present invention.

In the all-possible embodiments according to the present invention, a first connecting device may be used to connect the main body and the base plate of the receiving element, and a second connecting device may be used to connect the boards and the base plate. For example, the first connecting device may simply be a twin adhesive or a Velcro, or include a set of connecting elements accordingly disposed on the second side of the main body and the base plate of the receiving element. Surely, the shape, the size or the amount of the first connecting device can be changed depending on requirements. Please refer to FIG. 3, which is a schematic diagram showing the first connecting device according to a preferred embodiment of the present invention. As shown in FIG. 3, the first connecting device 31 mainly comprises a block 312 disposed on the second side of the main body 33 and a hole 311 disposed on the base plate of the receiving element 32. The hole 311 further has a circular hole 3111 and a column-shaped hole 3112, and the width of the block 312 is between the width of the circular hole 3111 and the width of the column-shaped hole 3112. After the block 312 is placed into the circular hole 3111 and pushed to the column-shaped hole 3112, the block 312 would therefore be engaged on the column-shaped hole 3112 so as to position the receiving element 32 on the second side of the main body 33 of the electronic apparatus 30.

Figure 4:
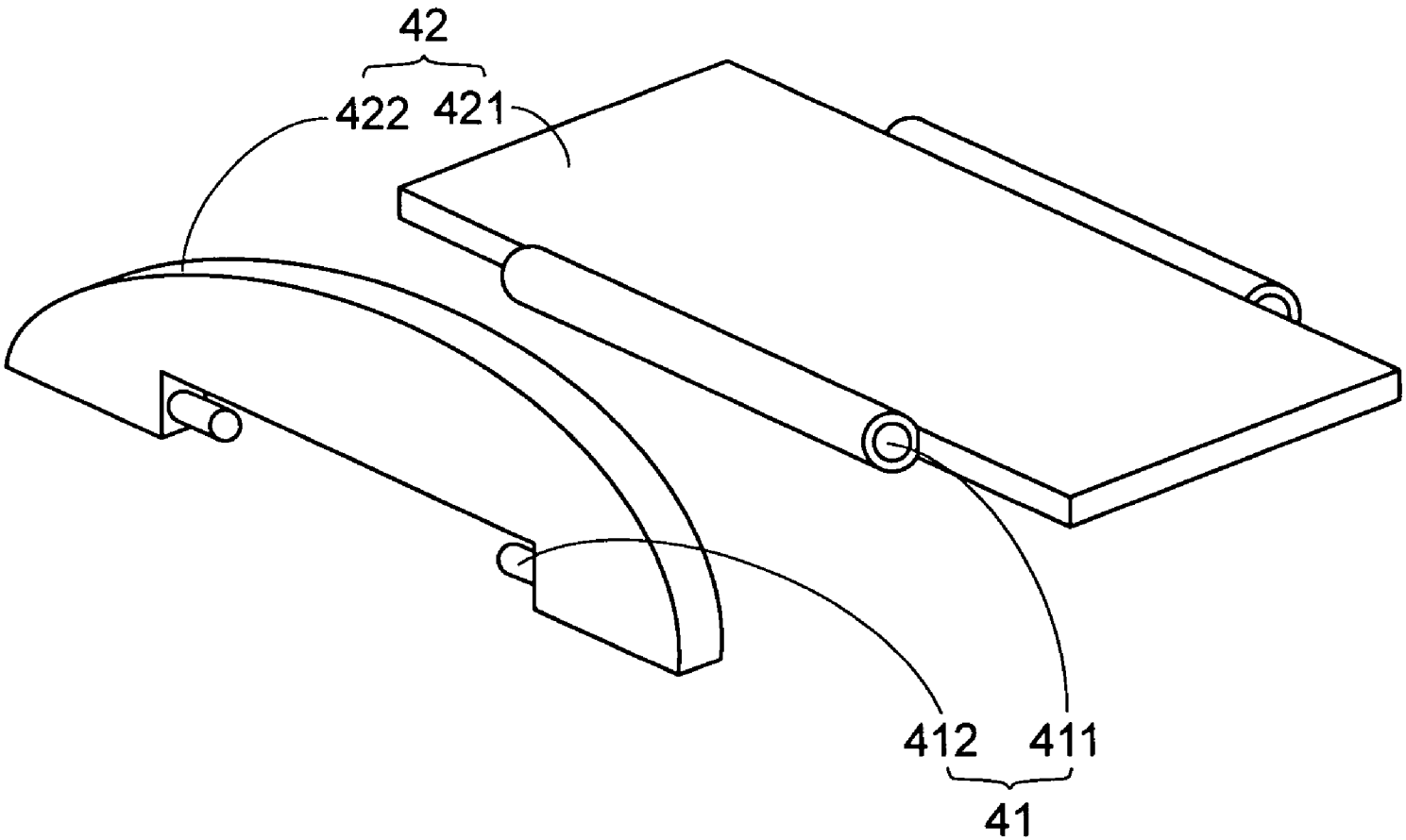
FIG. 4 is a schematic diagram showing the second connecting device according to a first preferred embodiment of the present invention.

On the other hand, please refer to FIG. 4, which is a schematic diagram showing the second connecting device according to a first preferred embodiment of the present invention. As shown in FIG. 4, the second connecting device 41 includes a protrusion 412 and an indentation 411. The protrusion 412 is disposed on the bottom of the board 422 and the indentation 411 is accordingly disposed on one side of the base plate 421 for receiving the protrusion 412. The protrusion 412 is placed into the indentation 411 and allows the board 422 to be rotatable to the base plate 421. Therefore, the board 422 of the receiving element 42 can be rotated to cover the received power cord around the electronic apparatus if it is needed.

Figure 5:
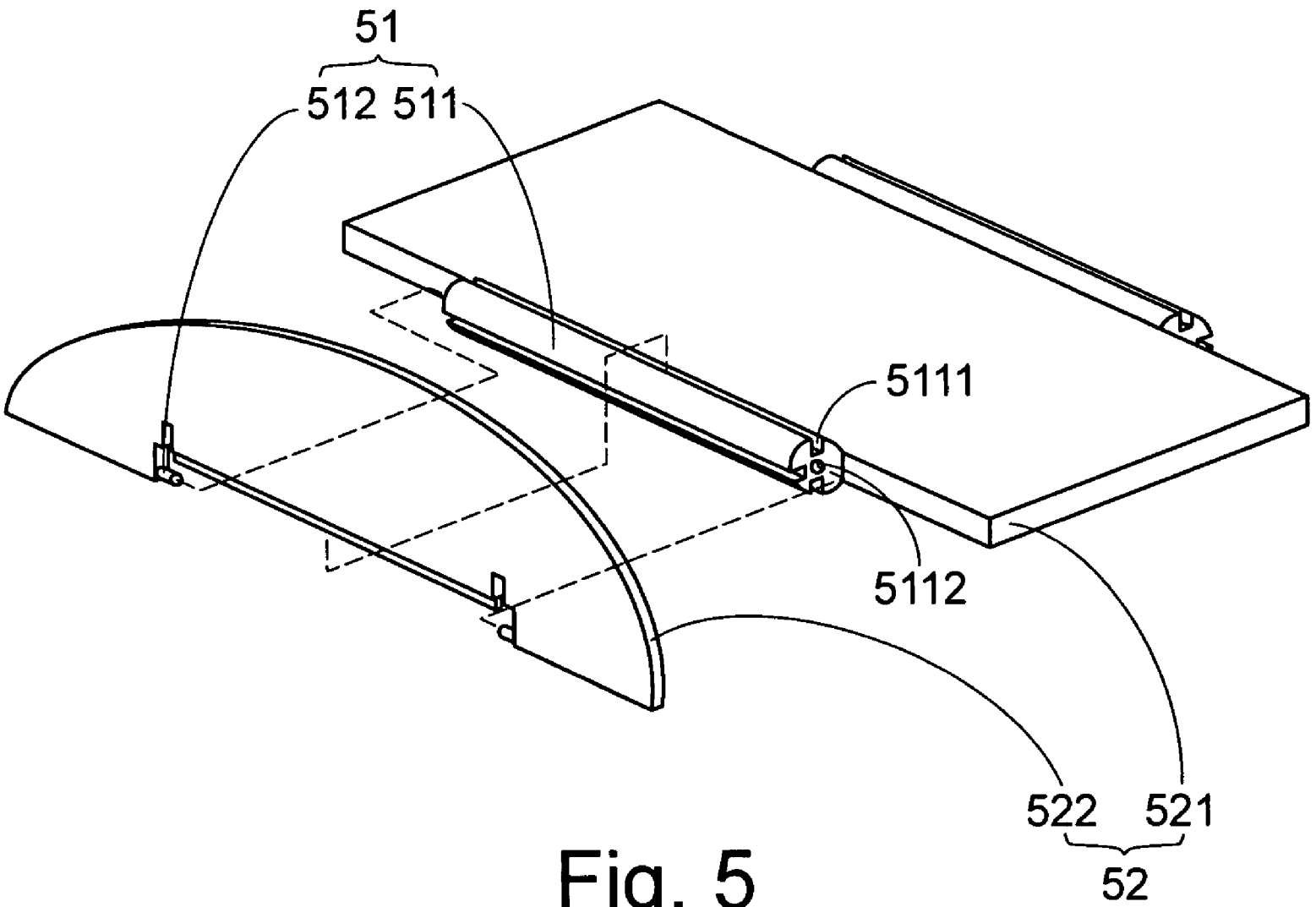
FIG. 5 is a schematic diagram showing the second connecting device according to a second preferred embodiment of the present invention.

Certainly, the second connecting device may have other elements. For example, please refer to FIG. 5, which is a schematic diagram showing the second connecting device according to a second preferred embodiment of the present invention. As shown in FIG. 5, the second connecting device 51 may include a cylinder 511 disposed on one side of the base plate 521. The cylinder 511 has an indentation 5112 disposed on the end of the cylinder 511 for receiving the protrusion 512 disposed on the bottom of the board 522, and further has a plurality of grooves 5111 respectively disposed on the surface thereof. Thereby, the board 522 is rotatable to the base plate 521 and can be received in one of the grooves 5111, so that the board 522 can be positioned at a specific position according to the need. Particularly, when the receiving element 52 is not in use, the board 522 can be positioned at the same plane of the base plate 521, which would decrease the whole volume of the electronic apparatus.

Figure 6:
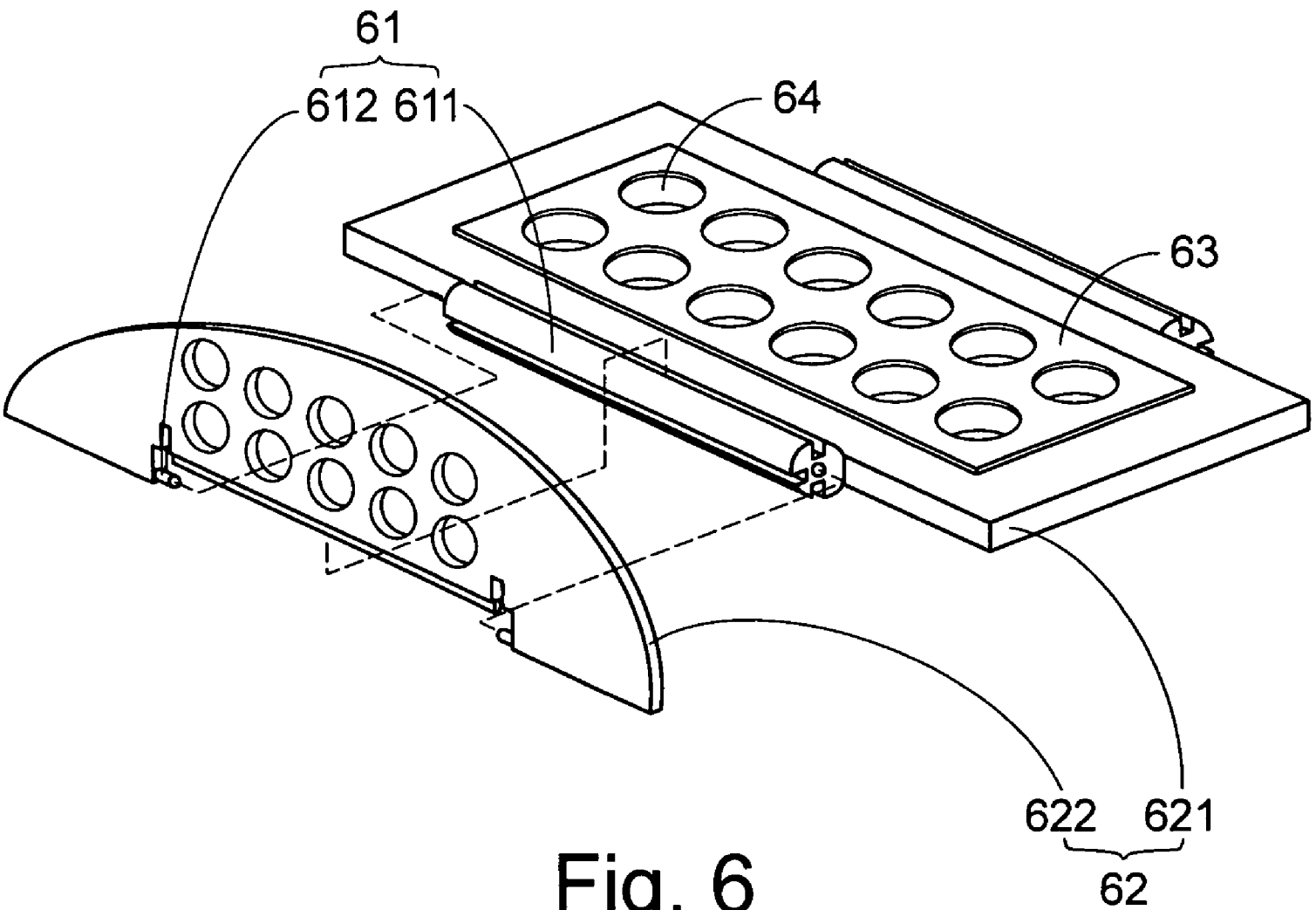
FIG. 6 is a schematic diagram showing the receiving element according to a preferred embodiment of the present invention.

Please further refer to FIG. 6, which is a schematic diagram showing the receiving element according to a preferred embodiment of the present invention. As shown in FIG. 6, the receiving element 62 includes a base plate 621 and a board 622 as described. The base plate 621 and the board 622 have a second connecting device 61 comprising a cylinder 611 having an indentation and a protrusion 612 to connect to each other, wherein the base plate 621 of the receiving element 62 is covered by a sheet metal 63 to improve the heat-dissipating effect of the electronic apparatus (not shown). Further, the base plate 621 and the board 622 have through holes 64 (or blind holes) for flowing air therethrough to dissipate the heat generated from the electronic apparatus.

In the above-mentioned embodiments, the base plate and the board of the receiving element may be shaped in a rectangle, a rhombus, a triangle, a circle, an ellipse or any other shapes. Further, the mounting manner of the receiving element on the main body of the electronic apparatus can be changed. Also, the engagement manner of the base plate and the board of the receiving element can be modified according to the need. Certainly, the base plate and the board can also be formed integrally. Besides, the amount and the volume of the receiving elements are not limited. Every style of the receiving elements capable of receiving the power cord of the electronic apparatus is applicable in the present invention. In addition, sine the receiving elements can be disposed on every side of the electronic apparatus, the power cord of the electronic apparatus can be wound in three different directions according to the need.

To sum up, the electronic apparatus of the present invention has receiving elements disposed on sides thereof, and the two boards of the receiving element can form a receiving space, so that the power cord of the electronic apparatus can be received and wound on the receiving element. Further, since the receiving element can be positioned at a specific position, the user can adjust the state of the receiving element according to the need. More important, because a plurality of the receiving elements can be disposed on the electronic apparatus, the whole heat-dissipating area of the electronic apparatus is increased, and thus the heat-dissipating effect of the electronic apparatus is increased. Moreover, a space for airflow exists between the electronic apparatus and the surface on which the electronic apparatus is placed due to the specific height of the receiving element, so the heat-dissipating effect of the electronic apparatus can be further enhanced. In addition, the receiving elements of the present invention are fixed on the electronic apparatus, so it is not easily lost. Therefore, the electronic apparatus having a function of receiving a power cord according to the present invention can not only solve the drawbacks of the prior art but also increase the heat-dissipating effect of the electronic apparatus, so the present invention possesses industrial values.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic apparatus having a function of receiving a power cord, comprising:

a main body;

a power cord connected to a first side of said main body; and at least a receiving element having a base plate and two boards, wherein said base plate is separately disposed on a second side of said main body and said two boards are respectively connected to two opposite sides of said base plate;

thereby allowing said power cord to be wound around said electronic apparatus and received at a receiving space formed between said two boards.

2. The electronic apparatus according to claim 1 wherein said electronic apparatus is one selected from a group consisting of an adapter, a power supply and a charger.

3. The electronic apparatus according to claim 1 wherein said main body and said base plate further have a first connecting device therebetween.

4. The electronic apparatus according to claim 1 wherein said base plate and said board have a second connecting device therebetween.

5. The electronic apparatus according to claim 1 wherein said base plate of said receiving element is shaped in a rectangle, a rhombus, a triangle, a circle or an ellipse.

6. The electronic apparatus according to claim 1 wherein said board of said receiving element is shaped in a rectangle, a rhombus, a triangle, a circle or an ellipse.

7. The electronic apparatus according to claim 1 wherein said receiving element further comprises a sheet metal covering said base plate or said board of said receiving element.

8. The electronic apparatus according to claim 1 wherein said receiving element further comprises a through hole or a blind hole.

9. The electronic apparatus according to claim 1 wherein the receiving element is disposed on the second side of the main body according to a user's preference.

10. The electronic apparatus according to claim 3 wherein said first connecting device is a twin adhesive or a velcro.

11. The electronic apparatus according to claim 3 wherein said first connecting device comprises:

a block disposed on said second side of said main body or said base plate; and a hole accordingly disposed on said base plate or said second side of said main body for engaging with said block;

thereby allowing said receiving element to be disposed on said second side of said main body.

12. The electronic apparatus according to claim 11 wherein said hole has a circular hole and a column-shaped hole, and the width of said block is between the width of said circular hole and the width of said column-shaped hole.

13. The electronic apparatus according to claim 4 wherein said second connecting device comprises:

a protrusion disposed on one side of said base plate or bottom of said board; and an indentation accordingly disposed on bottom of said board or said side of said base plate for engaging with said protrusion;

thereby allowing said board to be connected to said base plate.

14. The electronic apparatus according to claim 4 wherein said second connecting device comprises a cylinder disposed on one side of said base plate and having a plurality of grooves respectively disposed on the surface of said cylinder, wherein said grooves are used for holding said board so as to position said board when said board is rotated.

* * * * *